United States Patent [19]

Breinholt

[11] 4,261,572

[45] Apr. 14, 1981

[54] PYRAMIDAL FORTUNE-TELLING GAME

[76] Inventor: Mark W. Breinholt, 1217 Hudson Ave., Salt Lake City, Utah 84106

[21] Appl. No.: 970,458

[22] Filed: Dec. 18, 1978

[51] Int. Cl.[3] ..... A63F 9/18; A63F 9/04

[52] U.S. Cl. ..... 273/161; 273/145 C

[58] Field of Search ..... 273/161, 145 C, 145 CA, 273/145 D, 145 E, 146

[56] References Cited

U.S. PATENT DOCUMENTS

| | | | |
|---|---|---|---|
| 647,621 | 4/1900 | Turner | 273/145 C |
| 880,640 | 3/1908 | Emerson | 273/161 |
| 1,506,715 | 8/1924 | Ordway | 273/144 B |
| 3,603,593 | 9/1971 | Chew | 273/161 |

FOREIGN PATENT DOCUMENTS

| | | | |
|---|---|---|---|
| 114899 | 11/1929 | Austria | 273/146 |
| 2331800 | 1/1975 | Fed. Rep. of Germany | 273/145 C |
| 1383479 | 11/1964 | France | 273/145 C |
| 245022 | 2/1926 | Italy | 273/145 C |

*Primary Examiner*—Anton O. Oechsle

*Attorney, Agent, or Firm*—Thorpe, North, Western & Gold

[57] ABSTRACT

A game for simulated fortune-telling including a closed, pyramidal container with transparent faces permitting observation of the interior of the container and including dice enclosed therein for producing numerical combinations from the faces thereof referencing pre-determined statements of prediction or fortune. The game is used by tumbling the dice within the container interior and allowing them to come to rest on a base surface which is decorated with artwork relating to pyramid power symbols or the like. Various statements of fortune are identified in a numerical sequence which corresponds to the various combinations of numerical values represented on the faces of the dice.

6 Claims, 1 Drawing Figure

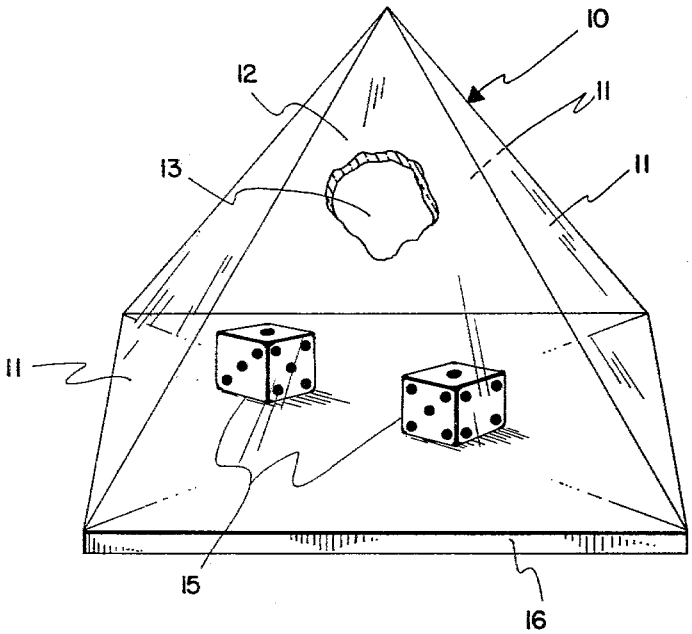
10
12
11
13
11
11
15
16

PYRAMIDAL FORTUNE-TELLING GAME

BACKGROUND OF THE INVENTION

1. Field of the Invention

This invention pertains to game apparatus for simulated fortune-telling, and more particularly to games of chance relying on random selection of numbers for use with a pre-determined list of statements of fortune.

2. Prior Art

Numerous games of chance have been developed which provide entertainment by simulated fortune-telling. Many of these games rely on the random identification of symbols which are coordinated with pre-determined statements of fortune which make predictions as to wealth, fame, romance, success in business, etc. Several games of chance include simulated interrogation of a "crystal ball" or other device which responds with answers based on random selection.

OBJECTS AND SUMMARY OF THE INVENTION

It is an object of the present invention to provide a game of chance in which questions are directed to a pyramidal-shaped container having dice therein which are tumbled to identify a number representing a predetermined answer to the question proposed by the player.

It is a further object of this invention to provide a coordinated list of questions of general interest for use with a second list of statements which operate as answers in a variety of forms to each of the specified questions.

These and other objects are realized in a game apparatus which includes a closed, pyramidal-shaped container having a pyramidal-shaped cavity interior, the cavity having at least one transparent face to permit visual observation therein. A die or dice are used with numerical designations or statements which represent or incorporate statements of fortune. The die is sufficiently small to allow free, tumbling movement within the interior of the container so that as the die comes to rest, it designates a particular statement of fortune representing a response of simulated fortune-telling to the applicable player. Pre-determined questions can be directed to the game apparatus, which then references one of several pre-determined answers corresponding to the simulated fortune of the particular player posing the question.

Other objects and features of the present invention will be apparent from the following detailed description taken in combination with the accompanying drawing in which:

The sole FIGURE illustrates a pyramidal container having dice enclosed therein in accordance with the present invention.

DETAILED DESCRIPTION OF THE INVENTION

Referring now to the drawing:

The game apparatus includes a pyramidal container 10 having a plurality of faces 11 which are triangular in shape and meet at two edges thereof with other faces to form the top section of a four-sided pyramid. At least one of these sides is a transparent face 12 which permits observation into the interior of the container 10. The respective faces 11 and 12 of the container function as walls to define a pyramidal-shaped cavity interior 13 which should be sufficiently large to permit free, tumbling motion of dice 15 to be contained therein.

Although a standard die havig six faces and dot groups on each face representing the respective numerals one through six are appropriate for the subject invention, other die configurations may likewise be applicable. At least three faces will be necessary so that tumbling motion can be developed, with the die coming naturally to rest on one of the die faces. When a greater selection of statements of fortune is desired, an increased number of faces on the die may be implemented. The combinations of values available on a standard six-face die are sufficient to provide a good selection of statements of fortune for most game applications.

Although the drawing shows a conventional set of dice having dot group designations for each numeral, other symbols could be utilized on the die face to coordinate with the designating symbol used for identification of a particular statement of fortune. Such symbols might include letters, Arabic numerals or mystic symbols associated with fortune-telling tradition. The significant function is to provide coordination between the randomly-selected die face and an appropriate statement of fortune having corresponding symbol identification.

The pyramidal-shaped cavity interior 13 of the container 10 is enclosed by a base 16 which is attached at the base of each triangular face forming the pyramid shape. This base may be transparent, or may be enhanced with artwork including mystic symbols associated with fortune-telling, pyramid power or other graphic symbols useful to designate this base as the surface on which the dice are intended to come to rest. As disclosed in the FIGURE, the base 16 should have sufficient surface area to permit complete and concurrent contact by one face of each die 15 at said surface.

The pyramidal container may be fabricated from sheets of plastic which are cut to the appropriate geometric configuration and glued at the seams to form an enclosing structure. Alternatively, the upper section comprising the sides of the pyramid may be injection-molded with the base piece being added after the dice are enclosed.

Although numerous polyhedron configurations may be selected for use with the tumbling die contained therein, the pyramid shape is disclosed as a preferred embodiment to incorporate a semblance of pyramid power associated with that particular shape.

The method of play for the subject game apparatus is represented in the following steps.

1. A player would select a question of personal interest from a list of questions enclosed as part of the game apparatus. An example of such questions might include, "Is financial investment appropriate at this time?" Obviously numerous types of questions can be developed covering the broad areas of general interest such as romance, wealth, travel, personality characteristics, business success, etc.

2. The player would then grasp the pyramidal container whose size and shape are adapted for being held in the hand, and shake it to actuate tumbling motion with the die. The player is instructed to concentrate his attention on the particular question selected while shaking the container with enclosed die.

3. While continually concentrating on the specific selected question, the player then places the container on its base or otherwise holds the container with the base in level position so that the dice come to rest thereon. The exposed, upright die faces represent the symbols to be coordinated with a single answer in a list of answers pertaining to the question asked. This random selection is considered to reflect the unique answer applicable to the player involved. In the case of dot groups, the numerical values for the respective exposed faces of the dice are compared to the corresponding numbers identified on the list of answers to give the specific answer of interest. The list of answers, for example, may include numerous varieties of answers for a single question which has been selected. The specific combination of symbols from the die represent the chance selection of the appropriate answer.

It will be apparent that numerous variations within the subject principles are envisioned. Such variations include differences in geometrical shapes for both the container and the die, as well as various forms of symbols to be placed on the respective faces of the die. All such variations are to be considered as part of the invention, whose express definition is to be obtained from the following claims.

I claim:

1. A game apparatus for simulated fortune-telling comprising:

a closed, pyramidal container having a pyramidal-shaped cavity interior, said container having at least one transparent face which permits visual observation of said cavity interior and having a base surface sufficiently large to permit complete and concurrent between said surface and a face of a die, a die contained within said cavity and having at least three faces which incorporate identification symbols of statements of fortune, said die being of sufficiently small dimensions with respect to cavity size that free, tumbling movement of the die within said cavity is permitted; and a list of statements of fortune wherein each statement has a designating symbol for singular identification thereof with respect to the identification symbol on each respective face of the die.

2. A game apparatus as defined in claim 1, wherein said pyramidal container comprises a five-faced polyhedron, one of said faces being operable as a base on which the die is to come to rest following tumbling movement within said cavity, said transparent face comprising one of the remaining four faces.

3. A game apparatus as defined in claim 1, wherein said die includes six faces, each face having said symbol thereon which incorporates identification of a statement of fortune.

4. A game apparatus as defined in claim 1, wherein said designating symbols are numerals and wherein the die faces include dot groups on each face of said die, each of said dot groups being unique in number and having numerical value to correspond singularly or in combination with other dot groups to a unique designating symbol identifying a single statement of fortune on said list.

5. A game apparatus as defined in claim 1, wherein the pyramidal container is constructed of plastic material, four faces being transparent and a fifth face having a decorative cover to distinguish it as a base on which the die is to come to rest following tumbling movement.

6. A game apparatus as defined in claim 1, further comprising a list of pre-determined questions coordinated with said statements of fortune.

* * * * *